US012654890B2

(12) United States Patent
Engelhardt et al.

(10) Patent No.: US 12,654,890 B2
(45) Date of Patent: Jun. 16, 2026

(54) POUCH CONTAINMENT AND CARTON LOADING

(71) Applicant: R.A Jones & Co., Covington, KY (US)

(72) Inventors: William E. Engelhardt, Morning View, KY (US); Steven C. Hamilton, Felicity, OH (US); Eric M. Schaefer, Cincinnati, OH (US)

(73) Assignee: R.A Jones & Co., Covington, KY (US)

( * ) Notice: Subject to any disclaimer, the term of this patent is extended or adjusted under 35 U.S.C. 154(b) by 0 days.

(21) Appl. No.: 18/659,646

(22) Filed: May 9, 2024

(65) Prior Publication Data

US 2024/0286779 A1 Aug. 29, 2024

Related U.S. Application Data

(62) Division of application No. 17/536,329, filed on Nov. 29, 2021, now Pat. No. 12,006,083, which is a (Continued)

(51) Int. Cl.

| | |
|---|---|
| ***B65B 5/06*** | (2006.01) |
| ***B65B 7/20*** | (2006.01) |
| ***B65B 35/40*** | (2006.01) |
| ***B65B 35/44*** | (2006.01) |
| ***B65B 35/50*** | (2006.01) |

(Continued)

(52) U.S. Cl.

CPC ..... *B65B 5/061* (2013.01); *B65B 7/20* (2013.01); *B65B 35/40* (2013.01); *B65B 35/405* (2013.01); *B65B 35/44* (2013.01); *B65B 35/50* (2013.01); *B65B 63/022* (2013.01); *B65B 39/007* (2013.01); *B65B 39/145* (2013.01)

(58) Field of Classification Search

CPC B65B 5/06; B65B 5/061; B65B 35/40; B65B 35/405; B65B 35/44; B65B 35/50; B65B 39/007; B65B 39/145; B65B 63/02; B65B 63/022; B65B 63/028

See application file for complete search history.

(56) References Cited

U.S. PATENT DOCUMENTS 2,631,767 A 3/1953 Banks
2,747,350 A 5/1956 Cargill et al.

(Continued)

OTHER PUBLICATIONS

European Patent Office, International Search Report and Written Opinion of the International Searching Authority, International Application No. PCT/US2019/026733, mailed Jul. 17, 2019 (16 pages).

(Continued)

*Primary Examiner* — Joshua G Kotis
(74) *Attorney, Agent, or Firm* — Wood Herron & Evans LLP

(57) ABSTRACT

A stack of products such as pouches is formed in a product bucket, pushed into a stack guide bucket and from there into a carton. A stack tamp descends over the stack, engages and confines it downwardly during stack pushing from product bucket and through stack guide bucket into a carton. Multiple product buckets, stack guide buckets and cartons move downstream during cartoning, and are respectively aligned in a cartoning station. Reciprocal containment blades hold the stack in respective cartons prior to flap closing.

5 Claims, 6 Drawing Sheets

Related U.S. Application Data division of application No. 16/377,487, filed on Apr. 8, 2019, now Pat. No. 11,214,390.

(60) Provisional application No. 62/661,184, filed on Apr. 23, 2018.

(51) Int. Cl.

| | |
|---|---|
| ***B65B 39/00*** | (2006.01) |
| ***B65B 39/14*** | (2006.01) |
| ***B65B 63/02*** | (2006.01) |

(56) References Cited

U.S. PATENT DOCUMENTS

| | | | | |
|---|---|---|---|---|
| 2,923,112 | A | 2/1960 | Harker | |
| 3,114,226 | A | 12/1963 | Taggart et al. | |
| 3,139,714 | A | 7/1964 | Hall | |
| 3,269,091 | A | 8/1966 | Le Roy | |
| 3,370,549 | A | 2/1968 | Livingston | |
| 3,678,649 | A | 7/1972 | Clancy | |
| 3,724,185 | A * | 4/1973 | Berney | B65B 43/285 53/566 |
| 3,822,008 | A | 7/1974 | Benner, Jr. et al. | |
| 3,906,705 | A | 9/1975 | Beck et al. | |
| 3,932,983 | A | 1/1976 | Hughes | |
| 4,526,564 | A | 7/1985 | Hughes | |
| 4,553,668 | A * | 11/1985 | James | B65D 71/00 53/436 |
| 5,175,976 | A | 1/1993 | Petry et al. | |
| 5,560,183 | A * | 10/1996 | James | B65B 35/50 53/542 |
| 6,202,392 | B1 | 3/2001 | Greenwell et al. | |
| 6,619,014 | B2 | 9/2003 | Muller | |
| 6,637,174 | B1 * | 10/2003 | Dietrich | B65B 35/40 53/251 |
| 7,549,265 | B2 | 6/2009 | Grabowski et al. | |
| 10,196,162 | B2 | 2/2019 | Rasi | |
| 10,875,674 | B2 | 12/2020 | Yokota et al. | |
| 2001/0039785 | A1 * | 11/2001 | Greenwell | B65G 47/244 53/473 |
| 2008/0184670 | A1 * | 8/2008 | Grabowski | B65B 35/405 53/252 |
| 2008/0209867 | A1 | 9/2008 | Lidington | |
| 2015/0158611 | A1 | 6/2015 | Kalany et al. | |
| 2015/0203228 | A1 * | 7/2015 | Johnson | B65B 43/39 198/339.1 |

OTHER PUBLICATIONS

The International Bureau of WIPO, International Preliminary Report on Patentability and Written Opinion of the International Searching Authority, International Application No. PCT/US2019/026733, mailed Nov. 5, 2020 (10 pages).

European Patent Office, Extended European Search Report, Application No. 22192114.1, mailed Nov. 22, 2022 (8 pages).

* cited by examiner

POUCH CONTAINMENT AND CARTON LOADING

PRIORITY CLAIM

The present application is a Divisional application of co-pending U.S. Ser. No. 17/536,329, filed Nov. 29, 2021, which is a Divisional application of U.S. Ser. No. 16/377,487, filed Apr. 8, 2019, now U.S. Pat. No. 11,214,390, issued Jan. 4, 2022, which claims the benefit of the filing date of U.S. Provisional Patent Application Ser. No. 62/661,184, filed Apr. 23, 2018. These applications are incorporated herein in their entireties by reference as if wholly and expressly reproduced herein.

FIELD OF THE INVENTION

This invention relates to packaging and cartoning of products, such as stacks of pouches, sachets or the like, into cartons.

BACKGROUND OF THE INVENTION

In packaging equipment and, in particular, cartoning machinery, it is common and necessary to condition the incoming product to ensure that the product can reliably be loaded into a carton, particularly where the product comprises a plurality of stacked items, such as pouches, and even more specifically where the pouches are of non-uniform or asymmetric shape. Conditioning can include a variety of processes. One such conditioning process could be the reshaping of the incoming product to insure it will fit into the carton. Another form of conditioning could be to contain the product in a way so as to not disturb the shape of product. Yet another form could be to both reshape and contain the product.

More particularly, it will be appreciated that in the case of unstable product or groups of products, such as stacks of non-uniform shaped pouches, it is important to also prevent the product from slouching or falling over during cartoning or out of the yet unclosed, unsealed carton once loaded. Stacks of pouches, for example, are notoriously unstable and the pouches tend to slump over in disorderly fashion from a symmetrical stack. Reliable product loading of formed stacks has a significant impact on the efficiency of the cartoning machinery since a failed carton load (i.e., slumped over stack) cannot be reliably loaded and adds to scrap produced and to down time to correct. As well, failure of intended loading parameters reduces cartoning speeds and throughput.

The problem with stackings of pouches for cartoning is further exacerbated as noted above when pouches are asymmetric, such that they bulge out when filled and are not flat.

PRIOR ART

Several prior methods are known for achieving more reliable cartoning of product stacks. One such method involves conditioning the product in a way that will reshape it so that there will be an interference fit between the carton and the pouches preventing the stacks from falling out. Another method uses a system where the carton is tipped over or inclined during loading so to reorient and contain the stack of pouches through gravity, preventing them from falling out of the carton. Such reorientation results in the open end of the carton inclined or facing up thus containing the loaded pouches preventing them from slouching or falling out through the forces of gravity.

It is thus one objective of the invention to provide apparatus and methods for loading products, such as product stacks, into cartons without disturbing the stacks or having them fall over or out of the cartons, by whatever means, before the cartons are closed.

SUMMARY OF THE INVENTION

This invention contemplates a containment and loading apparatus and process preventing the stacks of pouches, once formed up, from being disoriented, being disheveled, slumping, slouching, all the way through the cartoning process to the point where the cartons are closed and glued.

More particularly, the invention contemplates apparatus and methods maintaining constant control of a stack of pouches from formation of the stack in a product bucket through stack-loaded carton closure.

One preferred embodiment of the invention contemplates loading pouches individually, one atop another into a three-sided product bucket from a direct drop knife upstream of a cartoning station. The bucket has a partial sidewall through which a sliding stack pusher can pass. One elongated static stack guide plate contains one end of the stack at an open bucket end to, but not through the cartoning station, where the guide terminates. A stack guide bucket is positioned between a loaded product bucket and a carton to be loaded, for receiving the pushed pouch stack from the product bucket and directing the contained stack into the open end of a carton having closed flaps at the other end.

A tamp foot descends on the stack in the product bucket and extends over the stack guide bucket, holding the stack from above while a sliding pusher from a barrel loader extends through the partially open product bucket side wall to push the controlled stack from the product bucket, through the stack guide bucket and into the open end of the carton.

Once the stack is in the carton, a containment blade descends against the rear or pushed side of the loaded stack to further contain the stack while the carton flaps at the open end of the carton are closed.

Preferably, the tamp foot is raised when or after the containment blade descends and returns for deployment in connection with another stack-filled product bucket.

It is apparent that the pusher slide, the product bucket, the stack guide bucket and the open cartons are each independently carried on conveyors in parallel machine directions as are the reciprocal tamp foot and containment blade on respective conveyor apparatus, in the machine direction, above the lower moving elements noted above. It is also apparent that the product buckets are filled with pouches in a position upstream of the cartoning station.

Said in another way, the invention herein contemplates a method wherein a moving product bucket loaded with a product stack is aligned with a moving stack guide bucket, in turn aligned with a carton to be filled. An aligned sliding pusher, operating transversely to the machine direction, advances to push the product stack from the product bucket into the stack guide and thence into the carton, all while the product stack is held down by a tamp foot over the stack in the product bucket and the stack product guide. In a further method step, a moving stack containment blade is disposed at the rear end of the product stack in the carton to contain the stack while carton flaps are disposed but not yet closed across the rear end of the loaded stack in the carton.

The tamp foot and the containment blade are moveable in the same common direction as the product bucket, product guide and carton in a cartoning station, but are also reciprocally mounted for operational vertical movement.

The motion of these components is preferably continuous but could be intermittent with the components operationally aligned or indexed as illustrated herein.

It has thus been an objective of the invention to provide apparatus and methods for retaining shape control for stacks of pouches moved from a product bucket into a carton.

Another objective of the invention has been to prevent product disorientation from a uniform stack of products in a product cartoning operation.

Another objective of the invention has been to provide apparatus and methods for continuously cartoning stacked products without disorientation of products in a product stack.

BRIEF DESCRIPTION OF THE DRAWINGS

These and other objectives and advantages are further described in the following written description and in the drawings wherein.

DETAILED DESCRIPTION OF THE INVENTION

Figure 1:
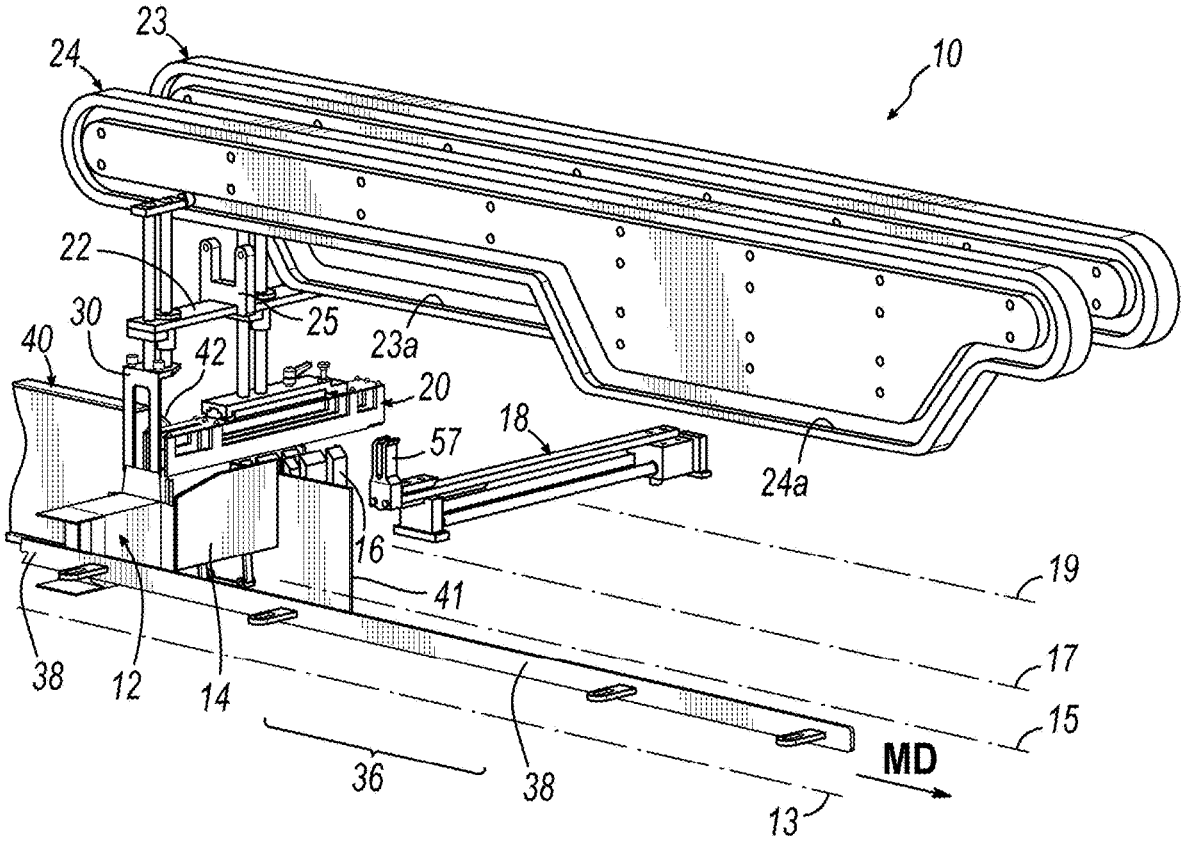
FIG. 1 is an isometric view of one embodiment of the invention.

Turning now to the Figures, FIG. 1 illustrates apparatus 10 for cartoning a stack of products, such as individual, stacked, asymmetric pouches without disorientation of a formed stack in a product bucket through stack transfer into a carton.

Figure 2A:
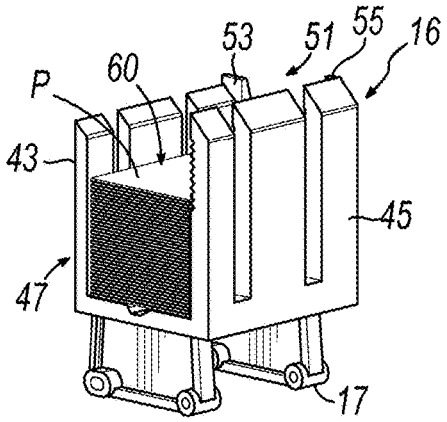
FIG. 2A is an isometric view of a product bucket as in FIG. 1 illustrating a stack of product or pouches therein.
Figure 2B:
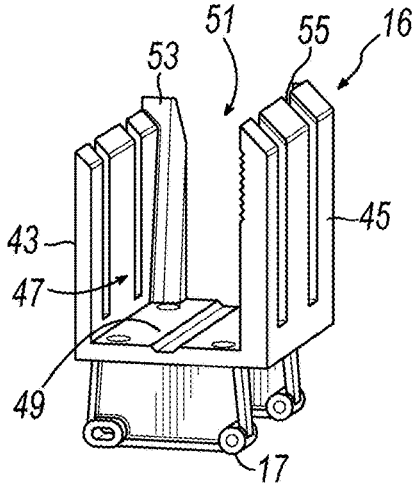
FIG. 2B is an isometric view of an unfilled product bucket as in FIGS. 1 and 2A.

Several multiple flap cartons 12 (one shown) to be filled are conveyed in a machine direction MD on a suitable carton conveyor 13 shown only graphically in FIG. 1. A series of moving product guide buckets 14 are conveyed (in machine direction MD) on a suitable product guide conveyor 15, shown only graphically in FIG. 1. A series of product buckets 16 are conveyed in a machine direction MD on a suitable product bucket conveyor 17, shown only graphically in FIG. 1. See bucket attachment components of conveyor 17 in FIGS. 2A and 2B.

A plurality of barrel loader slides 18 of any suitable barrel loader construction are mounted for movement in a machine direction MD on a barrel loader conveyor 19, shown only graphically in FIG. 1.

Figure 6:
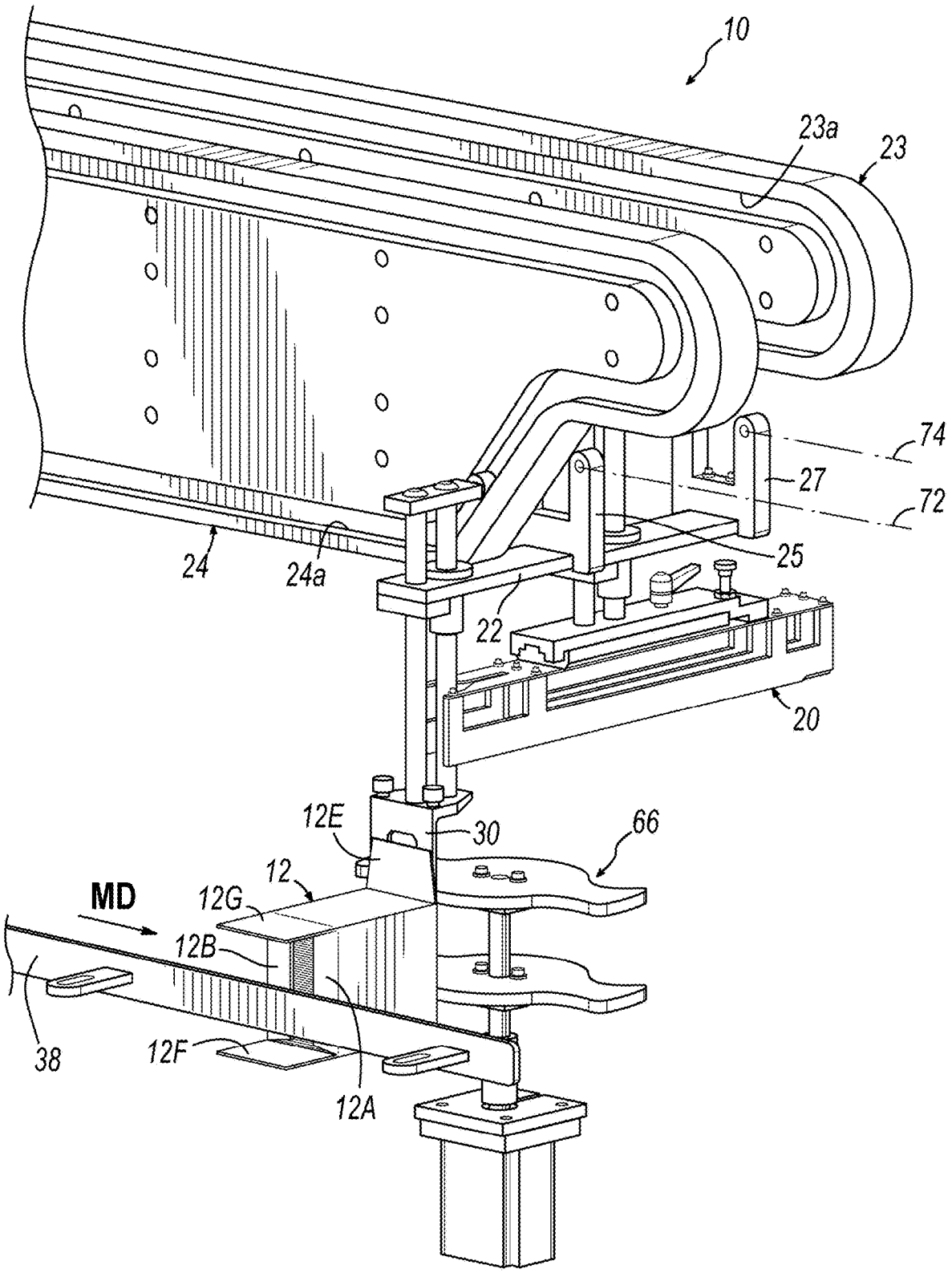
FIG. 6 is an enlarged isometric view of the right end portion of FIG. 1 illustrating the descended stack containment blade and the rotary carton flap closure stars.

A series of reciprocal stack tamps 20 are slidably mounted on carriages 22 (one shown) partially moveable in at least a machine direction MD and driven via carriage attachment components 25, 27 carried by respective chain runs 72, 74 (FIG. 6).

A series of reciprocal stack containment blades 30 is also mounted on carriages 22 for motion at least partially in a machine direction by virtue of components 25, 27, (FIG. 6).

A series of stack tamps 20 are vertically operated via cam 23, 23*a* while containment blades 30 are vertically operated via cam 24, 24*a* while both also move along in machine direction MD.

It will then be appreciated that all components 12, 14, 16, 18, 20, 30 are all moveable in a machine direction MD through a stack cartoning station 36 indicated by cartoning station range bracket 36.

In addition, it will be appreciated that tamps 20 and containment blades 30 are mounted for selective vertical motion perpendicularly to the machine direction MD, while all conveyors 13, 15, 17, 19, and chain runs 72, 74 are substantially parallel in operation in the downstream machine direction MD.

It will also be appreciated that the carriage 22 is carried by the components 25, 27, respectively connected to chain runs 72, 74 which are graphically depicted by the so numbered dotted lines in FIG. 6. Preferably, chain run 72 is disposed between and parallel to cam members 23, 24, while chain run 74 is oriented outside cam member 23. As noted, chain runs 72, 74 are parallel to cam members 23, 24 and are directed in a machine direction MD parallel to conveyors 13, 15, 17 and 19.

Thus carriage 22 is conveyed in machine direction MD, while carrying tamp feet 20 and containment blades 30.

Figure 7:
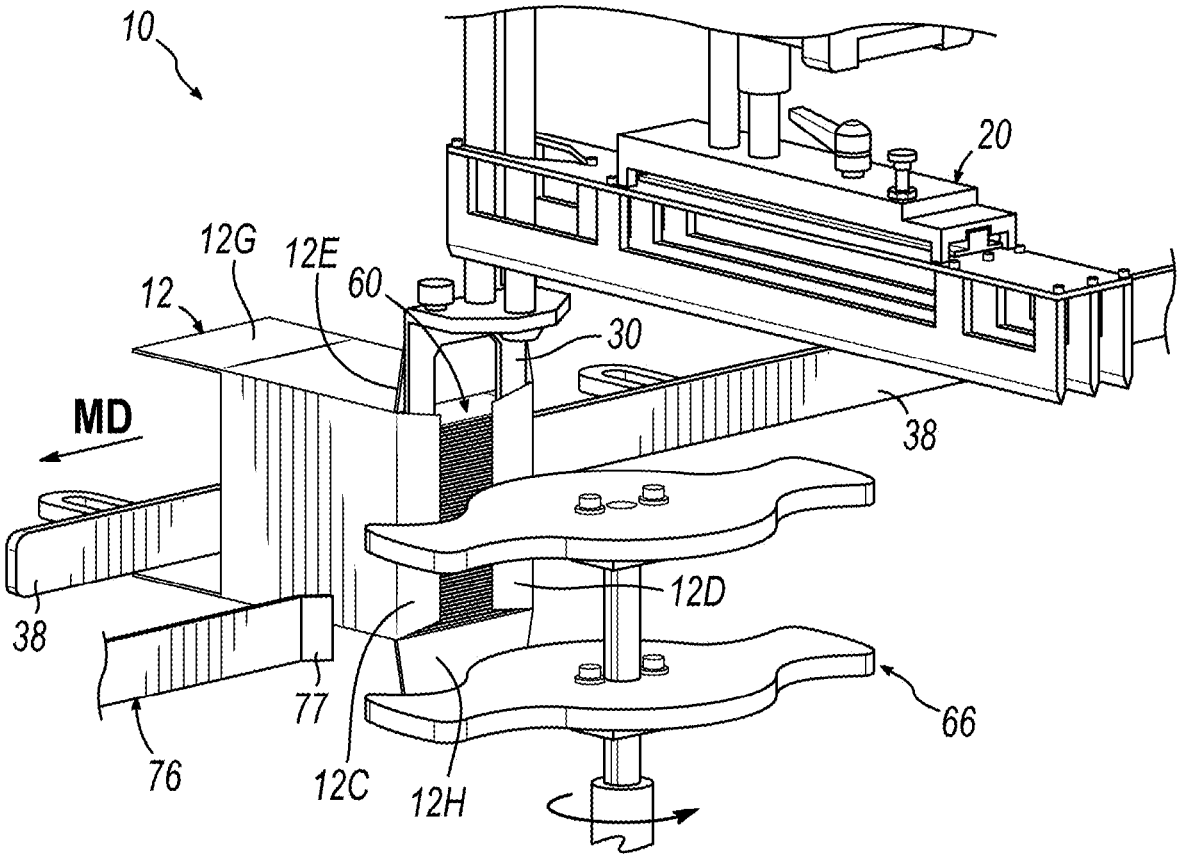
FIG. 7 is an enlarged isometric view of a portion of FIG. 6 as viewed from the back of a loaded carton and further illustrating the rotary carton flap closure stars and the product stack containment blade.

Moreover, it will be appreciated that the moving chain runs 72, 74 extend from upstream of a cartoning station 36, therethrough and beyond the position of the rotary flap closure 66 in the machine direction MD (FIG. 7), forming a loop with an operative path generally along a path of cams 23, 24.

An elongated guide 38 is disposed along a path traversed by cartons 12 in the machine direction MD for holding minor carton flaps 12A, 12B inwardly, forming a stop in carton 12 for a stack of products, such as pouches, when loaded into cartons 12.

An elongated static stack guide 40 is disposed along the machine direction MD from an upstream position where products are loaded into buckets 16, and terminating at an end 41. End 41 terminates at a position just short of cartoning station 36, so elongated static product guide 40 clears the moving stack guide bucket 14 in the machine direction MD just as guide bucket 14, and product bucket 16 pass downstream guide end 41 in cartoning station 36.

As illustrated in FIG. 1, cartoning station 36 is located just downstream of end 41 of guide 40 in the machine direction MD. Bucket 16 in FIG. 1 has been filled but the product stack in product bucket 16, guide bucket 14 and carton 12 have not moved into station 36 in FIG. 1.

Elongated static guide 40 has an upper edge tapered downwardly at 42 (FIG. 1) to allow clearance for descending tamp feet 20 as they come into alignment with product bucket 16, product guide bucket 14 and carton 12 as they move continuously downstream in machine direction MD and into alignment at cartoning station 36.

Product bucket 16 (see FIGS. 2A, 2B) has three sides, including opposed sides 43, 45, open end side 47 and bottom 49. Bucket 16 also has an end 51, opposite open end 47, defined by two opposed partial sides 53, 55, defining a space therebetween for passage of stack pushers 57 conveyed by barrel loader slides 18.

Operation and Further Detail

In operation, a plurality of pouches P (FIG. 2A) are dropped into bucket 16 from any suitable loader such as by a direct drop knife at an upstream vacuum wheel (not shown). The pouches P form a pouch stack 60 in product bucket 16, the stack 60 formed and confined by bucket sides 43, 45, partial bucket sides 53 55, bottom 49, and the elongated static stack guide 40 while the bucket 16 moves downstream.

When each bucket 16 and aligned stack guide bucket 14 clear the end 41 of elongated static guide 40 in cartoning station 36, barrel loader 18 is activated, causing sliding pusher 57 thereof to extend between partial stack confining product bucket sides 53, 55 and push the formed stack 60 from product bucket 16 into stack guide 14. Pusher 57 motion continues, pushing stack 60 into the open end of carton 12, until stack 60 engages closed minor carton flaps 12A, 12B, held by flap guide 38.

Concurrently, tamp 20, moving in direction MD along with product bucket 16, stack guide bucket 14 and carton 12, descends onto the top of stack 60, confining and holding the stack 60 in its oriented form as the bucket 16 passes static guide edge 41.

Figure 3:
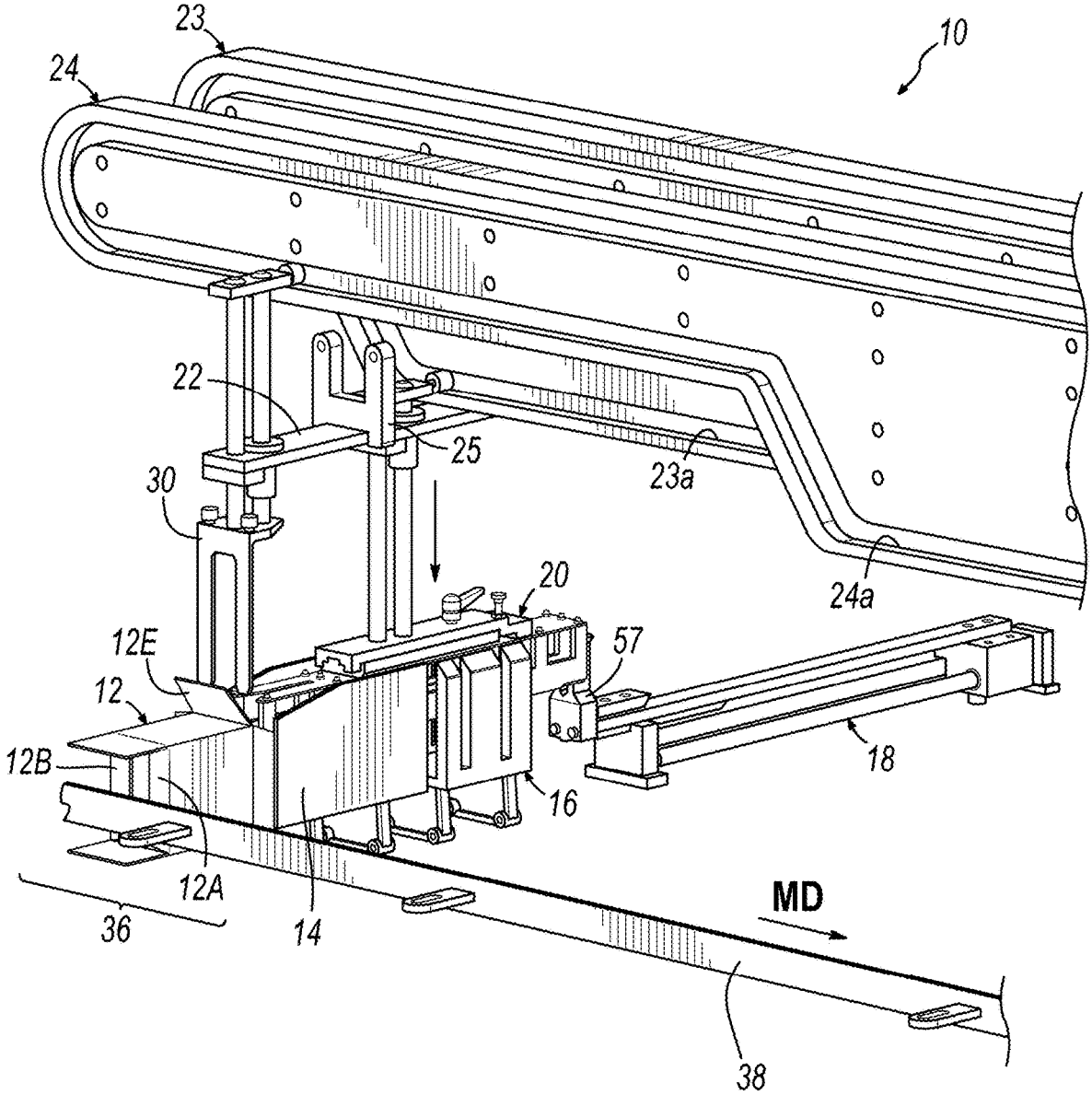
FIG. 3 is an enlarged isometric view of the left end portion of FIG. 1 for clarity.

FIG. 3 illustrates the lowered tamps 20 just prior to pushing by pusher 57. Containment blades 30 remain in an upper, retracted position.

Figure 4:
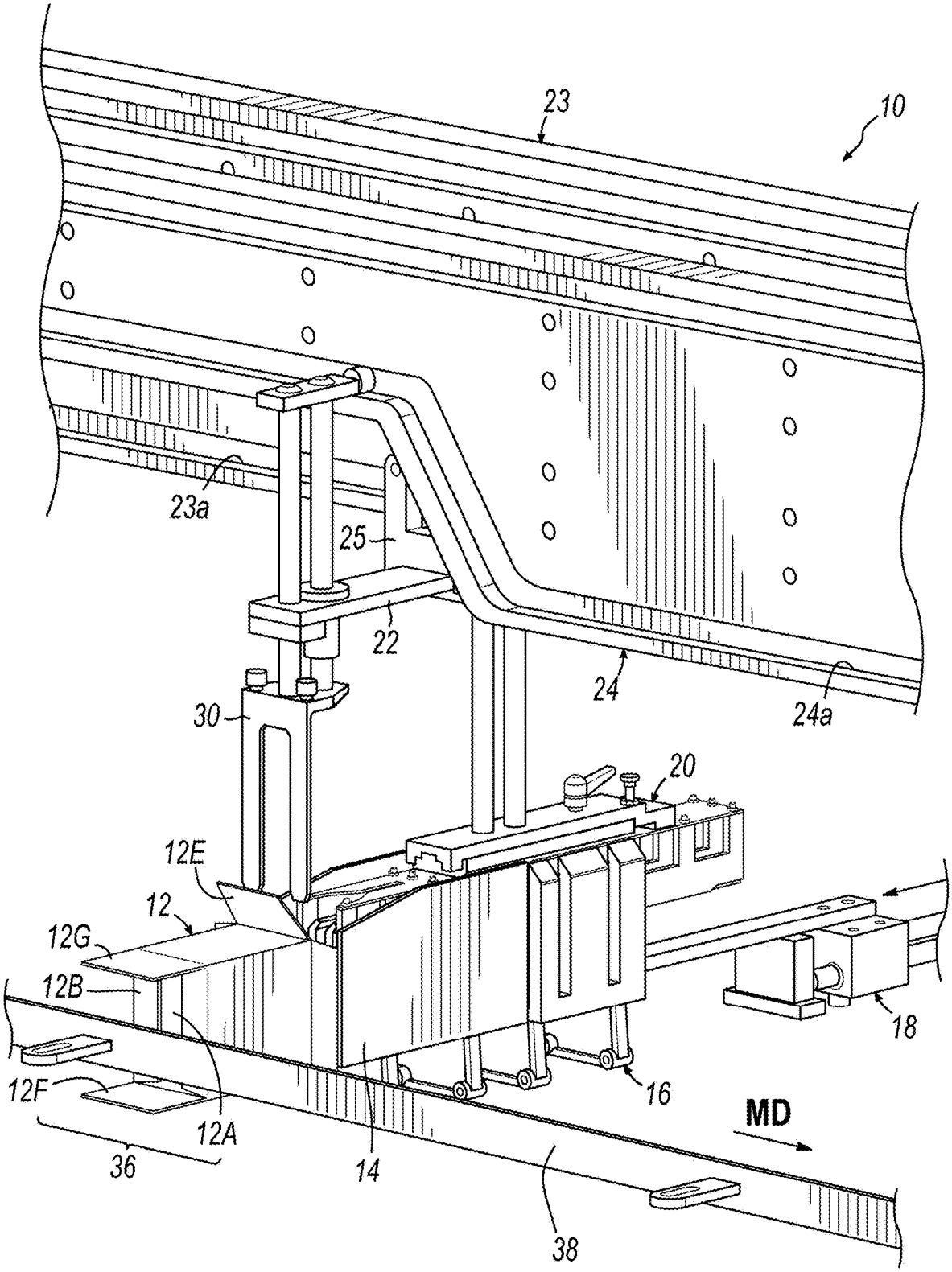
FIG. 4 is an enlarged isometric view as in FIG. 3 illustrating the stack pushing motion of the barrel loader.

FIG. 4 illustrates the yet incomplete pushing of stack 60 from product bucket 16 into stack guide bucket 14 with stack confining tamp 20 in descended lower position, confining stack 60.

Figure 5:
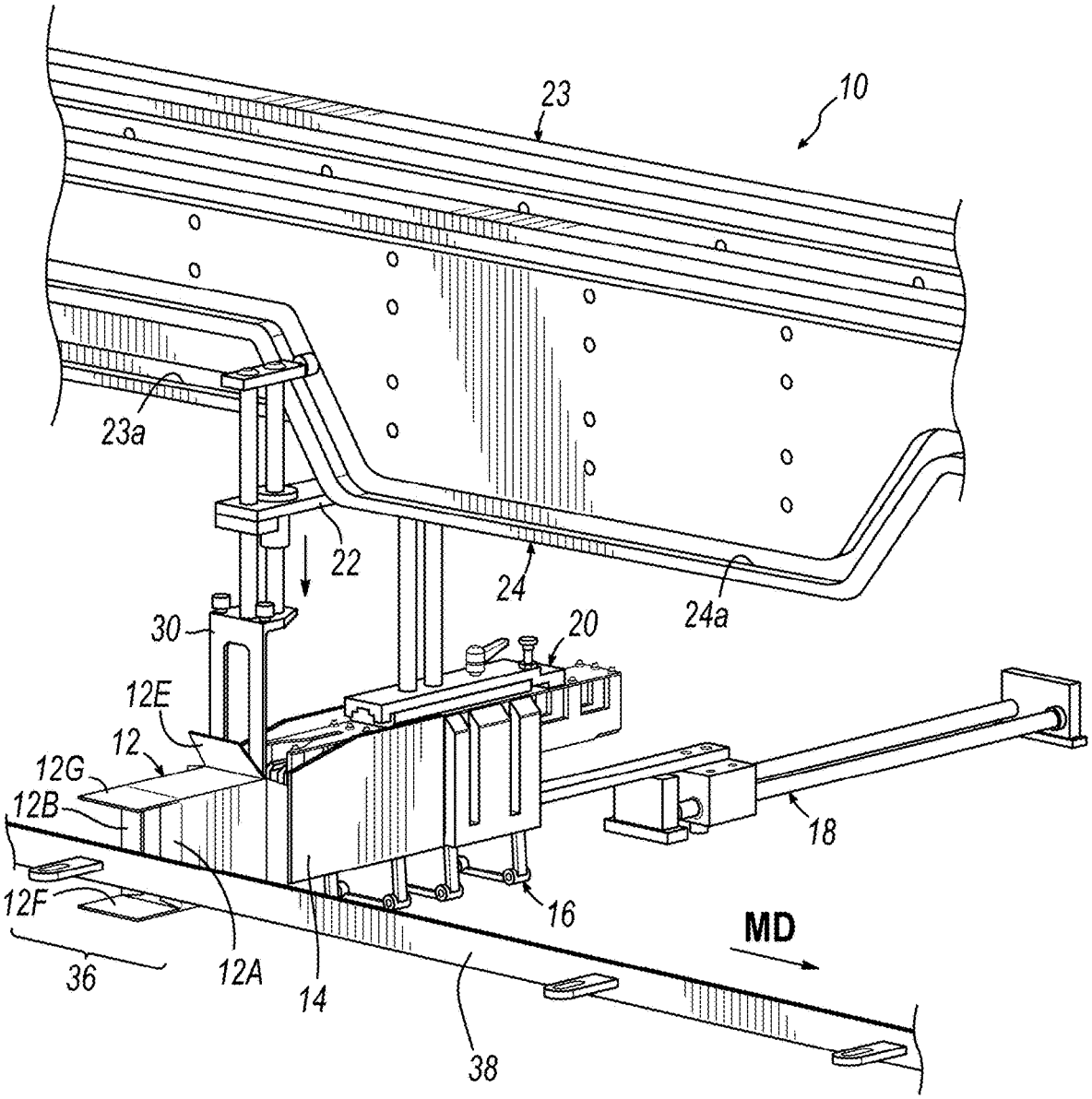
FIG. 5 is an enlarged isometric view as in FIG. 4 illustrating the vertical descent of the stack containment blade.

As the components continue downstream in the direction MD, pushing of stack 60 into carton 12, against carton flaps 12A, 12B is completed. FIG. 5 illustrates the beginning of downward motion of containment blades 30 across the rear end of the pushed stack 60 in carton 12 to confine stack 60 from slumping or falling backward when pusher 57 is withdrawn by barrel loader 57. Tamp 20 begins its ascent away from bucket 16 and guide bucket 14 (see FIG. 6).

Downstream of cartoning station 36 an elongated static carton flap guide 76 is positioned in the machine direction MD to engage the leading minor flap 12C with a tapered end 77. Further downstream motion of carton 12 moves the carton and flap 12C to engage guide end 77. Thereafter, rotary flap closer or star 66 rotates to fold trailing minor carton flap 12D against the product stack 60 in carton 12 and containment blade 30.

Carton end flaps 12E, 12F, 12G and 12H (FIG. 7) are then closed by appropriate carton flap guides (not shown).

Containment blades 30 remain in place while minor flaps 12C, 12D are folded inwardly against product stack 6. Once flaps 12C, 12D are held in place by static guide 76, containment blades 30 ascend and return for another cycle.

This confines the desired stack 60 to form in carton 12.

Thereafter, the stack-filled carton 12 proceeds downstream in direction MD for final closing, gluing or the like by any suitable means.

The tamps 20 have been raised and returned for another cycle.

It will be appreciated that reciprocal movement of tamps 20 and containment blades 30 are each initiated and controlled by distinct separate cams 23, 24 as shown for coordinated operation.

It will also be appreciated that while single elements or components 12, 14, 16, 18, 20, 22 and 30 are shown in the FIGS. for clarity, one preferred embodiment of the invention contemplates a plurality of each of these, driven continuously along from bucket loading to, through and beyond the cartoning station 36 with respective other like components for continuous cartoning operation, all while retaining control of the stacks and pouches as the stacks are formed, transported and loaded into cartons.

Also, it will be appreciated that while feet 20 are referred to herein as tamp feet, they also serve to confine the product stacks from the top whether or not any tamping motion is applied.

Finally, it will also be appreciated that the invention is useful not only in cartoning of asymmetric products or pouches but also in cartoning of stacks of a wide variety of uniform products.

What is claimed is:

1. A method of loading a stack of products into a carton moveable in a machine direction and comprising steps of:

depositing a stack of product in a moveable product bucket;

interposing a static stack guide across a discharge end of said product bucket;

moving said product bucket and a stack guide bucket in the machine direction past an end of said static stack guide for accommodating passage of the product stack into said stack guide bucket;

pushing the product stack into said stack guide bucket from said product bucket;

tamping the product stack in said product bucket and in said stack guide bucket;

pushing the tamped product stack from the stack guide bucket into the carton through a first end thereof;

vertically moving a stack containment blade to a position on a side of the pushed product stack in the carton, wherein the stack containment blade extends in a vertical direction;

closing first minor carton flaps toward the side of the product stack and the stack containment blade;

after the closing, withdrawing the stack containment blade from the stack; and moving the loaded carton in the machine direction.

2. The method as in claim 1 including a step of moving second minor carton flaps of a second end of said carton to a position partially closing said second end of said carton before pushing the product stack into the carton.

3. The method as in claim 1 including a step of moving a stack pusher, the product bucket and the stack guide bucket downstream in the machine direction when the product stack has been disposed in the carton.

4. The method as in claim 1 including a step of stacking asymmetric products in said moveable product bucket.

5. A method of cartoning a plurality of asymmetric products in a stack from a product bucket into a carton including steps of:

depositing said stack into the product bucket;

conveying the product bucket, containing said stack and having a discharge end, in a machine direction;

aligning a moveable stack guide bucket with said discharge end;

disposing an elongated static guide between said discharge end and said stack guide bucket and holding said stack in said product bucket;

moving said product bucket and said stack guide bucket in the machine direction downstream beyond said static guide;

tamping a top of said stack in said product bucket and in said stack guide bucket;

pushing the tamped stack from said product bucket into said stack guide bucket;

pushing said stack from said stack guide bucket into an open end of the carton;

vertically moving a stack containment blade to position the containment blade against the stack pushed into said carton, wherein the stack containment blade extends in a vertical direction;

moving carton flaps toward said stack and said containment blade; and after moving the carton flaps, withdrawing said containment blade from said stack.

* * * * *